United States Patent [19]

Anderson et al.

[11] 3,980,019

[45] Sept. 14, 1976

[54] ADAPTIVE ORDNANCE SYSTEM

[75] Inventors: Matthew E. Anderson, Ontario; Maurice H. Brown, Riverside, both of Calif.

[73] Assignee: The United States of America as represented by the Secretary of the Navy, Washington, D.C.

[22] Filed: Apr. 30, 1970

[21] Appl. No.: 43,617

[52] U.S. Cl. ..... 102/7.2; 102/69; 102/70.2 A

[51] Int. Cl.[2] ..... F42B 25/16

[58] Field of Search ..... 102/70, 70.2, 7, 7.2, 102/3, 69; 244/3.1

[56] References Cited

UNITED STATES PATENTS

| | | | |
|---|---|---|---|
| 1,278,578 | 9/1918 | Blackmore | 102/7.2 |
| 2,376,227 | 5/1945 | Brown | 102/7.2 X |
| 2,842,055 | 7/1958 | Mason | 102/24 HL |
| 2,960,033 | 11/1960 | Jackson | 102/7.2 X |

*Primary Examiner*—David H. Brown

*Attorney, Agent, or Firm*—R. S. Sciascia; G. J. Rubens; T. M. Phillips

[57] ABSTRACT

A system for selecting the mode of detonating a cluster warhead. The warhead consists of a number of bomblets which are configured to be packaged into a warhead cannister. An explosive switch is initiated which permanently opens the dispersing circuit and prevents the bomblets from being dispensed and the warhead is exploded in the unitary mode. Failure to open the dispersing circuit will permit the warhead to disperse and each bomblet will explode individually.

6 Claims, 3 Drawing Figures

MATTHEW E. ANDERSON
MAURICE H. BROWN
INVENTOR.

BY E. M. Phillips
J. M. St. Amand
ATTORNEYS

ADAPTIVE ORDNANCE SYSTEM

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to adaptive ordnance systems and more particularly to adaptive ordnance systems of the clustered warhead type. Conventional ordnance used against the wide variety of targets available in tactical warfare tends to be specialized for the type of target. Anti-personnel bomblets are used against troops (soft targets) to cover large areas. Anti-material bomblets or proximity-fuzed fragmentation warheads are used against radar vans (medium target) for moderate area coverage and more concentrated damage. Contact fuzed blast warheads are used against bridges (hard point target).

SUMMARY

The present invention provides an adaptive ordnance system which will provide the capability for missiles of attacking a wide range of targets from soft area types such as dispersed troops to hard point types such as bridges with a single weapon and provides greater effectiveness of guided weapons when there is a large miss distance caused by the loss of a strong guidance signal. The mode in which the ordnance system will function can be manually selected based on pilot assessment of the target, or automatically selected based on presence of or strength of the weapon guidance signal. The missile target detecting device measures target range and monitors the missile guidance signal. Upon sensing a degradation of guidance signal it triggers the deployment of the bomblets (dispersed mode) if the range to (or altitude above) the target is within the effective limits for this mode. If the range is below the effective limits for the dispersed mode, fuzing is held in abeyance, and the fuze then initiates the warhead at the effective range for the unitary mode. If the range is above the effective limits for the dispersal mode, fuzing is held in abeyance until the maximum dispersal range or altitude is sensed by the TDD. Accordingly, an object of the invention is the provision of an adaptive ordnance system which is effective against a wide range of targets and conditions.

Another object of the invention is to provide a selective ordnance system which when functioning in the unitary mode will be effective against hard targets.

Other objects and many of the attendant advantages of this invention will become readily appreciated as the same becomes better understood by reference to the following detailed description when considered in connection with the accompanying drawings wherein.

Figure 1:
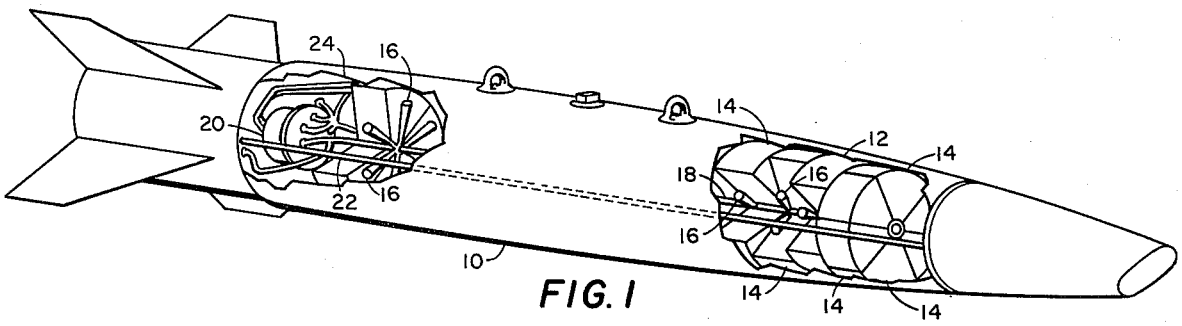
FIG. 1 shows a guided missile warhead modified in accordance with the teaching of the invention.

There is shown in FIG. 1 a guided missile 10 with portions broken away to show the arrangement of the selectable warhead and initiating means. The warhead 12 is composed of a plurality of pie-shaped bomblets 14 with the apex fitting over a pyrotechnic charge 16. The pyrotechnic charges 16 vary in size and strength of charge from fore to aft to give a difference in dispersal velocity of the bomblets 14. In the dispersal mode pyrotechnic charges 16 are ignited by means of a pyrotechnic lead 18 connected to fuze 20. Four flexible linear shaped charges 22 are positioned equal distances apart along the longitudinal axis on the intersurface of the missile skin 24.

Figure 3:
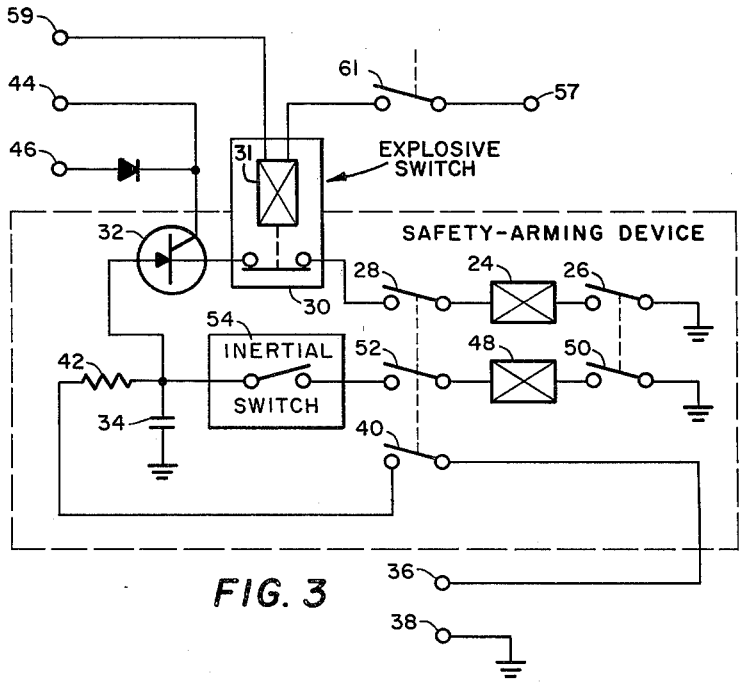
FIG. 3 shows a schematic diagram of the adaptive ordnance system.

Referring to FIG. 3, there is shown in schematic diagram form the selective ordnance system which consists of two igniting circuits. The dispersal mode igniting circuit consists of an igniter 24 connected in series with arming switches 26 and 28, a normally closed explosive switch 30 and a silicon controlled rectifier 32 to firing capacitor 34. Firing capacitor 34 is charged by a voltage from the missile power source applied at terminals 36, 38. The voltage at terminal 36 is applied through switch 40 and charging resistor 42. Silicon control rectifier 32 is controlled by a missile guidance signal voltage from the missile applied at terminal 44 and a firing signal from the target detecting device (not shown) applied at terminal 46. The unitary mode igniting circuit consists of an igniter 48 connected in series with arming switches 50, 52 and inertial switch 54 connected to firing capacitor 34. Explosive switch 30 is actuated by firing detonator 31 with a voltage from the launching aircraft's power source applied at terminals 57, 59 by means of switch 61.

In operation, if the pilot chooses to use the adaptive ordnance system in the unitary mode, he closes switch 61 which actuates explosive switch 30 and permanently opens the circuit to detonator 24 and prevents bomblets 14 from being dispersed. A good missile guidance signal (−6V) at terminal 44 inhibits the firing of detonator 24 by back biasing silicon controlled rectifier 32 with a negative voltage greater than the firing signal from the target detecting device at terminal 46. When the signal at terminal 46 reaches a value (+4 volts) to overcome the back biasing signal at terminal 44, SCR 32 will fire permitting firing capacitor 34 to discharge and actuate detonator 24.

Figure 2:
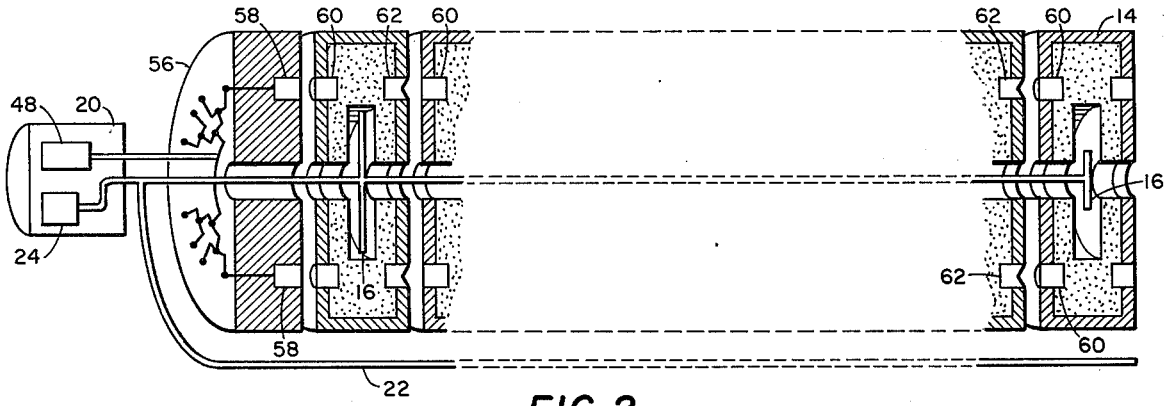
FIG. 2 shows the fuzing arrangement for initiating the warhead in either mode.

As shown in FIG. 2, detonation of the warhead in a unitary mode is accomplished by a hydraexplosive booster 56 positioned at the aft end of the packaged bomblets 14. Booster 56 contains multiple explosive paths with one path terminating at an explosive booster 58 aligned with an explosive acceptor 60 in each of the bomblets 14 with which it is in contact. Each bomblet contains an explosive acceptor 60 and a shaped charge explosive donor 62, so that once the first set of bomblets are detonated by detonator 48, the remainder of the bomblets 14 will be detonated in a chain reaction.

Dispersion of the warhead in the dispersed mode is accomplished by means of pyrotechnic charges 16 detonated by the pyrotechnic lead 18 which is connected to detonator 24 of fuze 20. Flexible linear shaped charges 22 are also connected to detonator 24 and are initiated simultaneously with the pyrotechnic charges 16 to sever the outer skin of the warhead canister.

I claim:

1. An adaptive ordnance system which is effective against a wide range of targets and conditions comprising:

a. a plurality of bomblets packaged in a single container, b. first detonator means associated with said packaged bomblets for detonating said bomblets as a unitary warhead in response to a first set of conditions, c. second detonator means associated with said packaged bomblets including circuit means connected to a first input terminal for receiving missile guidance signals and to a second input terminal to receive a firing signal and being responsive to a second set of conditions which includes the relative values of the signals received at said input terminals for dispersing said bomblets to fall in a predetermined pattern.

2. The adaptive ordnance system of claim 1 wherein said second detonator means includes circuit means for preventing dispersal of the bomblets as long as a strong guidance signal is present.

3. The adaptive ordnance system of claim 2 wherein said circuit means includes a silicon controlled rectifier which is biased non-conducting as long as a strong guidance signal is present.

4. The adaptive ordnance system of claim 1 wherein said second detonator means includes switch means for manually inactivating said second detonator means.

5. The adaptive ordnance system of claim 4 wherein said switch means includes an explosive switch.

6. The adaptive ordnance system of claim 1 wherein said first detonator means includes explosive booster means and explosive acceptor means for detonating the warhead as a unitary warhead.

* * * * *